US009086243B2

(12) United States Patent
Komori et al.

(10) Patent No.: US 9,086,243 B2
(45) Date of Patent: Jul. 21, 2015

(54) FIN-TUBE HEAT EXCHANGER

(75) Inventors: Kou Komori, Nara (JP); Osamu Ogawa, Kyoto (JP); Hiroki Hayashi, Kyoto (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 997 days.

(21) Appl. No.: 12/278,360

(22) PCT Filed: Feb. 6, 2007

(86) PCT No.: PCT/JP2007/052032
§ 371 (c)(1),
(2), (4) Date: Sep. 24, 2008

(87) PCT Pub. No.: WO2007/091561
PCT Pub. Date: Aug. 16, 2007

(65) Prior Publication Data

US 2009/0050303 A1 Feb. 26, 2009

(30) Foreign Application Priority Data

Feb. 6, 2006 (JP) ..... 2006-028062

(51) Int. Cl.
*F28F 1/32* (2006.01)
*F28D 1/047* (2006.01)

(52) U.S. Cl.
CPC ..... *F28D 1/0477* (2013.01); *F28F 1/325* (2013.01)

(58) Field of Classification Search
CPC ..... F28F 1/325; F28F 1/128; F28F 2215/08
USPC ..... 165/151, 171; 29/890.045, 890.046
See application file for complete search history.

(56) References Cited

U.S. PATENT DOCUMENTS

| | | | | | |
|---|---|---|---|---|---|
| 2,271,538 | A | * | 2/1942 | Brace | 165/150 |
| 3,437,134 | A | * | 4/1969 | Oddy | 165/151 |
| 3,850,236 | A | * | 11/1974 | O'Connor et al. | 165/181 |
| 3,886,639 | A | * | 6/1975 | Pasternak | 72/325 |
| 4,034,453 | A | * | 7/1977 | Tomita et al. | 72/338 |
| 4,365,667 | A | * | 12/1982 | Hatada et al. | 165/152 |
| 4,469,167 | A | * | 9/1984 | Itoh et al. | 165/151 |
| 4,614,230 | A | * | 9/1986 | Sakuma et al. | 165/151 |
| 4,691,767 | A | * | 9/1987 | Tanaka et al. | 165/151 |
| 5,111,876 | A | * | 5/1992 | Nash | 165/151 |
| 5,168,923 | A | * | 12/1992 | Sacks | 165/151 |

(Continued)

FOREIGN PATENT DOCUMENTS

| | | |
|---|---|---|
| FR | 406 841 | 2/1910 |
| GB | 1 313 973 | 4/1973 |

(Continued)

*Primary Examiner* — Allen Flanigan
(74) *Attorney, Agent, or Firm* — Hamre, Schumann, Mueller & Larson, P.C.

(57) ABSTRACT

A fin-tube heat exchanger has a plurality of fins (3) arranged parallel to and spaced from each other at a predetermined gap, and a plurality of heat transfer tubes (2) penetrating the fins (3). In each of the fins (3), a first cut-and-raised portion (5*a*), a second cut-and-raised portion (5*b*), and a third cut-and-raised portion (5*c*) are formed in that order by cutting and raising a portion of the each of the fins so as to turn it over from an upstream side to a downstream side. The horizontal cross-sectional shape of each of the first cut-and-raised portion (5*a*), the second cut-and-raised portion (5*b*), and the third cut-and-raised portion (5*c*) is formed in a semicircular shape and curved so as to taper toward the upstream side.

11 Claims, 14 Drawing Sheets

(56) References Cited

U.S. PATENT DOCUMENTS

| | | | | |
|---|---|---|---|---|
| 5,509,469 | A * | 4/1996 | Obosu | 165/151 |
| 5,647,433 | A * | 7/1997 | Sasaki | 165/148 |
| 5,848,638 | A * | 12/1998 | Kim | 165/151 |
| 5,887,649 | A * | 3/1999 | Kim | 165/151 |
| 7,231,965 | B2 * | 6/2007 | Shimoya et al. | 165/151 |
| 2004/0206484 | A1 * | 10/2004 | Shimoya et al. | 165/152 |
| 2005/0241813 | A1 | 11/2005 | Choi et al. | |
| 2006/0169019 | A1 * | 8/2006 | Kutscher et al. | 72/379.2 |

FOREIGN PATENT DOCUMENTS

| | | | |
|---|---|---|---|
| JP | 59-052363 | U | 4/1984 |
| JP | 59-103075 | A | 6/1984 |
| JP | 62-019692 | A | 1/1987 |
| JP | 9-264697 | | 10/1997 |
| JP | 11-108575 | A | 4/1999 |
| JP | 2001-116488 | A | 4/2001 |
| JP | 2004-263881 | A | 9/2004 |
| JP | 2005-121348 | A | 5/2005 |
| WO | WO 2004/065879 | A1 | 8/2004 |

* cited by examiner

| ELLIPTICITY A/B | AVERAGE HEAT TRANSFER COEFFICIENT | PRESSURE LOSS |
|---|---|---|
| 1 | 1.000 | 1.000 |
| 0.5 | 1.008 | 0.625 |
| 0.33 | 0.999 | 0.508 |

FIN-TUBE HEAT EXCHANGER

TECHNICAL FIELD

The present invention relates to fin-tube heat exchangers.

BACKGROUND ART

Conventionally, fin-tube heat exchangers commonly have been used for various apparatuses such as air conditioners, freezer-refrigerators, and dehumidifiers. A fin-tube heat exchanger is composed of a plurality of fins that are arranged parallel to each other and spaced with a predetermined gap, and heat transfer tubes that extend through these fins.

Known fin-tube heat exchangers include ones with various ingenious fin shape designs so as to enhance heat transfer. For example, a heat exchanger in which a large number of pins are provided on a fin surface has been known. In this heat exchanger, the flow on the fin surface is stirred by these pins, so heat exchange is thereby enhanced.

However, providing the pins, which are different members from the fin, additionally on the fin complicates the manufacturing process. In view of this, a heat exchanger in which the fin shape is made ingenious by cutting and raising portions of the fin often is employed. For example, JP 2001-116488 A discloses a fin-tube heat exchanger in which a plurality of slit-shaped cut-and-lifts (hereinafter also referred to as "slit portions") are formed. In this heat exchanger, the slit portions are formed by press-forming the fin so that the portions of the fin are cut and raised in a slit shape.

In a fin that has the slit portions (the fin is hereinafter also referred to as a "slit fin"), heat transfer is enhanced based on the following principle. In a fin 100 without the slit portions (flat fin), a continuous thermal boundary layer BL is produced from a front edge 100*a* of the fin 100 toward the rear when air A is supplied from the front, as illustrated in FIG. 12A. The thermal boundary layer BL is thin in the vicinity of the front edge 100*a*, but it gradually becomes thicker toward the rear. On the other hand, in a slit fin 101, as illustrated in FIG. 12B, the thermal boundary layer BL is produced not only from the front edge 101*a* of the fin 101 but also from each of the front edges 102*a* of the slit portions 102. Thus, it is possible to divide the thermal boundary layer BL from the front edge 101*a* of the fin 101 and to produce the thermal boundary layer BL discontinuously, as it were. Accordingly, the average thickness of the thermal boundary layer BL is thinner in the slit fin 101 than in the flat fin 100. As a result, heat transfer coefficient improves.

DISCLOSURE OF THE INVENTION

In the slit fin 101, however, the cross-sectional shape of the slit portions 102 is rectangular. Therefore, although it can obtain the effect of dividing the thermal boundary layer BL that develops from the front edge 101*a*, it has been unable to achieve further advantageous effects. Thus, even if some optimization in the dimensions of the slit portions 102, for example, is made, there have been certain limitations to improvements in heat transfer coefficient.

The present invention has been accomplished in view of the foregoing circumstances, and it is an object of the invention to provide a fin-tube heat exchanger that can achieve an improvement in heat transfer coefficient over prior art and at the same time maintains easy manufacturability.

A fin-tube heat exchanger according to the present invention includes: a plurality of fins spaced apart from and parallel to each other; and a plurality of heat transfer tubes penetrating the fins, the fin-tube heat exchanger being for exchanging heat between a first fluid flowing on a surface side of the fins and a second fluid flowing inside the heat transfer tubes, wherein a cut-and-raised portion is formed in each of the fins, the cut-and-raised portion being formed by cutting and raising a portion of the each of the fins so as to be turned over from an upstream side to a downstream side of a flow direction of the first fluid, and having a horizontal cross-sectional shape that is curved or bent so as to taper toward the upstream side.

The horizontal cross sectional shape of the cut-and-raised portion may be a semicircular shape. Alternatively, the horizontal cross sectional shape of the cut-and-raised portion may be a semielliptic shape. Alternatively, the horizontal cross sectional shape of the cut-and-raised portion may be a semielliptic shape that is slender toward the upstream side. In addition, the horizontal cross sectional shape of the cut-and-raised portion may be a wedge shape.

A plurality of the cut-and-raised portions may be provided along the flow direction of the first fluid, and the cut-and-raised portions that are adjacent to each other along the flow direction are cut and raised in alternately opposite directions from each of the fins.

A raised height of the cut-and-raised portion may be equal to or less than ½ of a fin pitch.

A plurality of the cut-and-raised portions may be provided along the flow direction of the first fluid, and the total length of the cut-and-raised portions with respect to the flow direction of the first fluid may be ½ to ⅔ of the length of the fins with respect to the flow direction of the first fluid.

A plurality of the cut-and-raised portions may be provided along the flow direction of the first fluid, and the number of the cut-and-raised portions along the flow direction may be equal to or less than 3 per one row of the heat transfer tubes.

A plurality of the cut-and-raised portions may be provided along the flow direction of the first fluid, and the flow direction length of the cut-and-raised portion located on the most upstream side may be longer than the flow direction length of the other cut-and-raised portion.

The fins may be configured so that an upstream side thereof along the flow direction of the first fluid is longer than a downstream side thereof, taking the center of the heat transfer tube as a reference.

In the fin-tube heat exchanger according to the present invention, a cut-and-raised portion is formed in the fins, and the horizontal cross-sectional shape of the cut-and-raised portion is curved or bent so as to taper toward the upstream side of the flow direction. Therefore, the thermal boundary layer of the fluid at the cut-and-raised portion can be made thinner. As a result, it becomes possible to improve the heat transfer coefficient over the prior art while maintaining easy manufacturability.

BEST MODE FOR CARRYING OUT THE INVENTION

Hereinbelow, embodiments of the present invention are described in detail with reference to the drawings.

(Embodiment 1)

Figure 1:
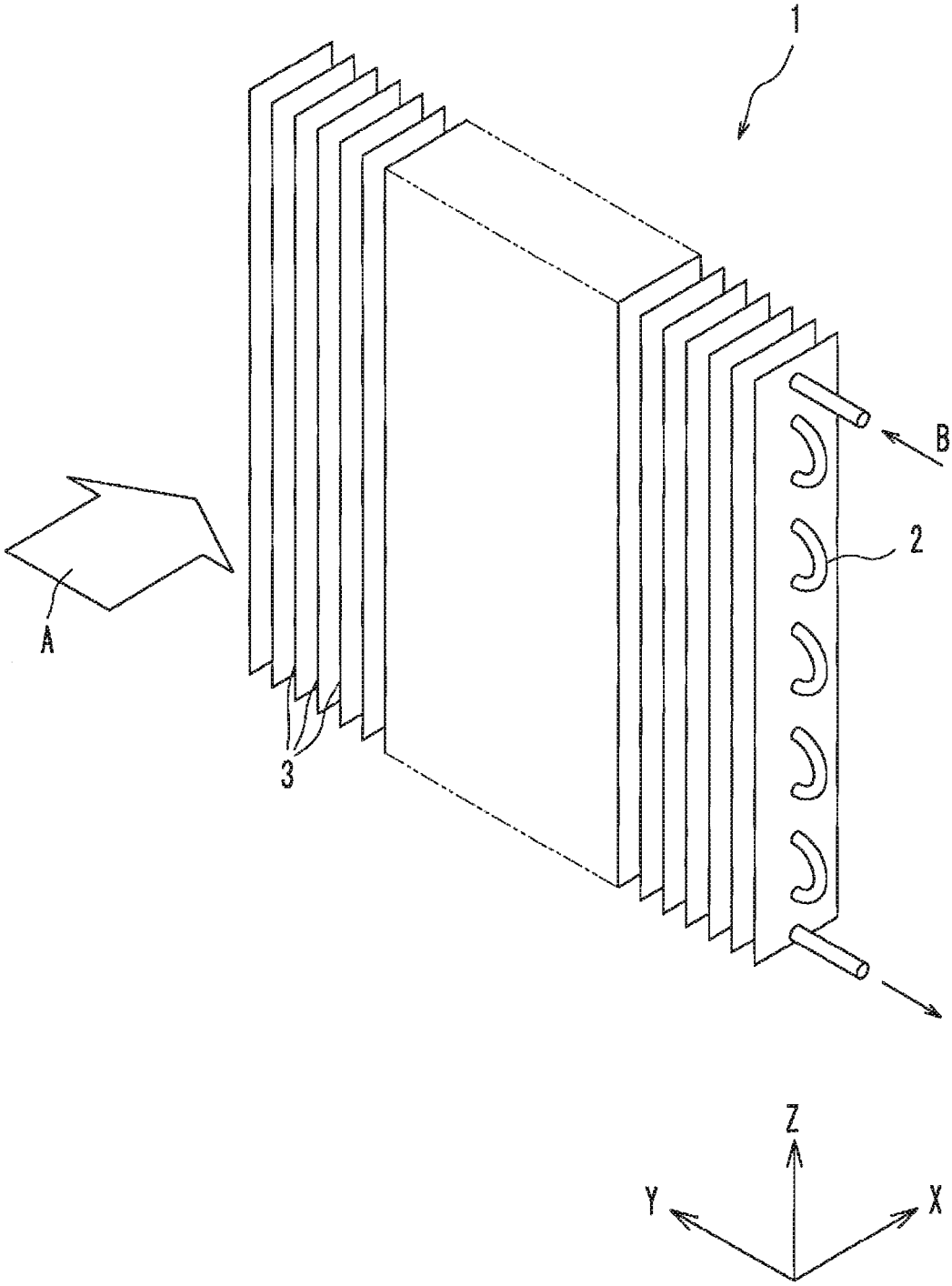
FIG. 1 is a perspective view of a fin-tube heat exchanger.

As illustrated in FIG. 1, a fin-tube heat exchanger 1 according to the embodiment has a plurality of fins 3 arranged parallel to each other with a predetermined gap, and a plurality of heat transfer tubes 2 penetrating these fins 3. The heat exchanger 1 is for exchanging heat between a fluid flowing inside the heat transfer tubes 2 and a fluid flowing on the surface side of the fins 3 (the surfaces of the fins 3 when the outer surfaces of the heat transfer tubes 2 are not exposed, or the surfaces of the fins 3 and the heat transfer tubes 2 when the outer surfaces of the heat transfer tubes 2 are exposed). In the present embodiment, air A flows on the surface side of the fins 3, and refrigerant B flows inside the heat transfer tubes 2. It should be noted that the fluid that flows inside the heat transfer tubes 2 and the fluid that flows on the surface side of the fins 3 are not particularly limited. Each of the fluids may be either a gas or a liquid.

The fins 3 are formed in a rectangular flat plate shape and are arranged in the Y direction shown in the figure. It should be noted that although the fins 3 are arranged with a certain gap in the present embodiment, the gap between them may not necessarily be uniform, and it may be varied. An aluminum flat plate subjected to a punch-out process and having a thickness of 0.08 mm to 0.2 mm, for example, may be used suitably for each of the fins 3. From the viewpoint of improving the fin efficiency, it is particularly preferable that the thickness of the fin 3 be 0.1 mm or greater. The surface of the fin 3 is treated with a hydrophilic treatment, such as a boehmite treatment or coating with a hydrophilic paint.

In the present embodiment, the heat transfer tubes 2 are arranged along the longitudinal direction of the fins 3 (hereinafter also referred to as the "Z direction"). It should be noted that the heat transfer tubes 2 may not necessarily be arranged in one row along the Z direction, but may be disposed in a staggered manner, for example. The outer diameter D of the heat transfer tubes 2 (see FIG. 2) may be, for example, from 1 mm to 20 mm, or may be 4 mm or less. The heat transfer tube 2 is in intimate contact with a fin collar (not shown, in FIG. 2 etc., the fin collar is also not shown) of the fin 3, and it is fitted to the fin collar. The heat transfer tube 2 may be a smooth tube in which the inner surface thereof is flat and smooth or a grooved tube in which grooves are formed in the inner surface thereof.

The heat exchanger 1 is installed in such a position that the flow direction of the air A (X direction shown in FIG. 1) is approximately perpendicular to the Y direction and the Z direction. That said, the airflow direction may be inclined slightly from the X direction as long as a sufficient heat exchange amount can be ensured.

Figure 2:
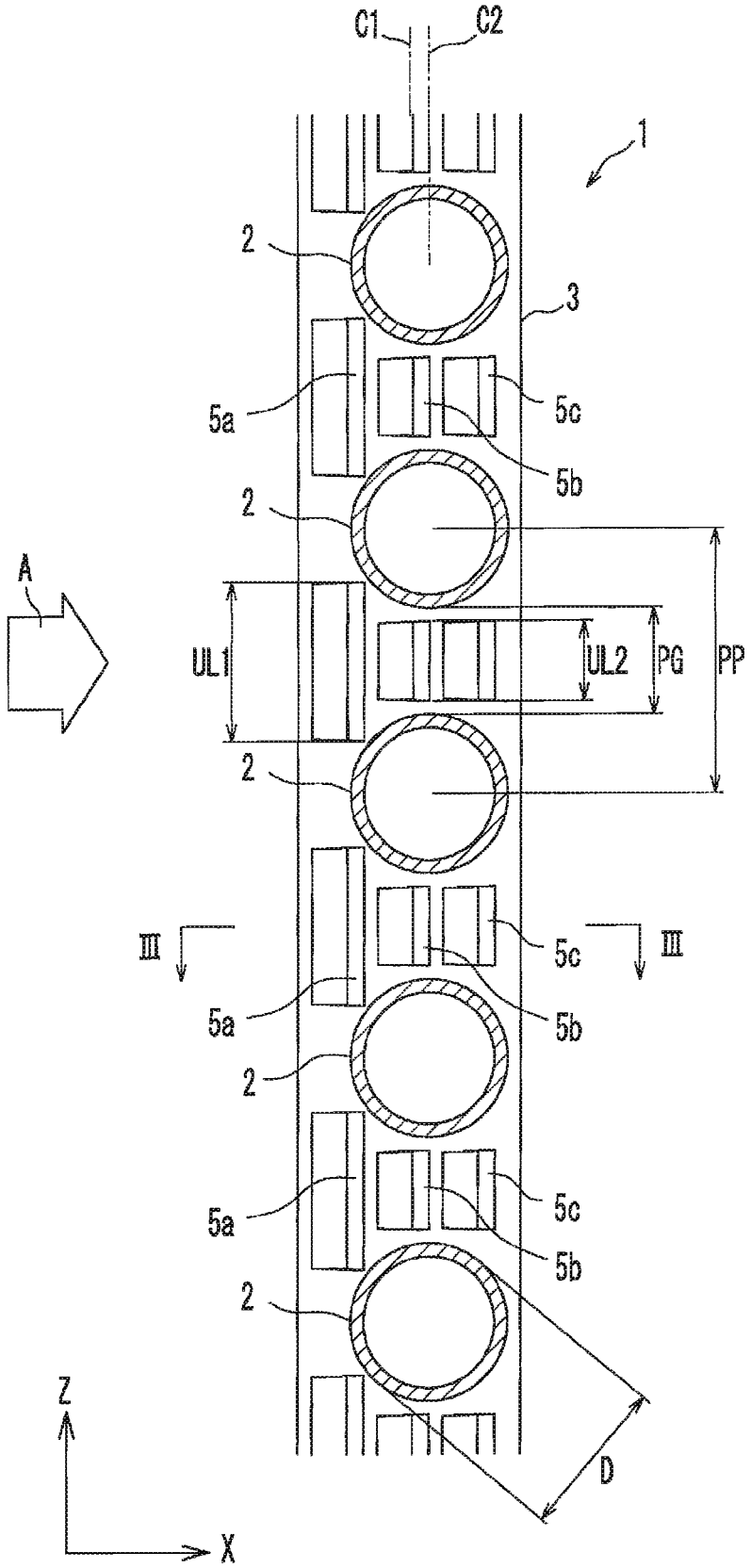
FIG. 2 is a partial elevational view of a fin.

As illustrated in FIG. 2, the center line C2 of the heat transfer tubes 2 deviates from the center line C1 of the fin 3 toward the downstream side of the airflow direction (the right side in FIG. 2). Accordingly, the upstream side (the left side in FIG. 2) of the fin 3 is longer than the downstream side thereof, taking the center line C2 of the heat transfer tube 2 as a reference. As described previously, the front edge portion of the fin 3 has a large local heat transfer coefficient. On the other hand, the rear of each of the heat transfer tubes 2 becomes a dead fluid region, in which the local heat transfer coefficient is small. Thus, in the present the heat exchanger 1, the front edge portion of the fin 3 is extended frontward while the rear edge portion of the fin 3 is made shorter. Therefore, the present the heat exchanger 1 can increase the area of the portion in which the heat transfer coefficient is large, and at the same time, it can reduce the area of the portion in which the heat transfer coefficient is small.

Figure 3A:
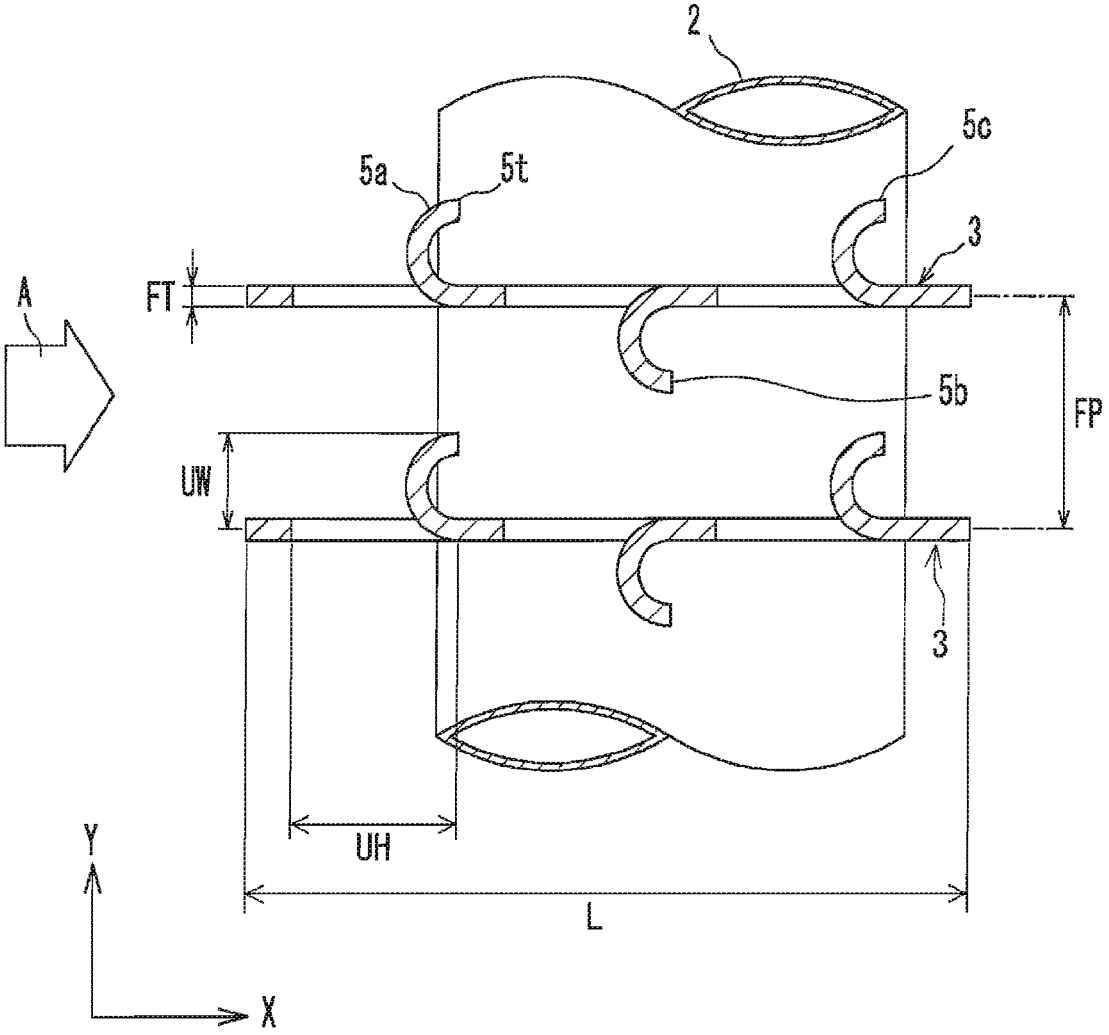
FIG. 3A is an enlarged view of a primary portion of the fin-tube heat exchanger according to Embodiment 1.

In the fin 3, a first cut-and-raised portion 5*a*, a second cut-and-raised portion 5*b*, and a third cut-and-raised portion 5*c* are formed in that order from the upstream side to the downstream side of the airflow A, as illustrated in FIGS. 2 and 3A. The first to third cut-and-raised portions 5*a*-5*c* are formed in each space between the heat transfer tubes 2 that are adjacent to each other, and a plurality of sets of the first to third cut-and-raised portions 5*a*-5*c* are provided along the Z direction.

Each of the cut-and-raised portions 5*a*-5*c* is a portion of the fin 3 that is cut and raised in such a manner that it is turned over from the upstream side to the downstream side. As illustrated in FIG. 3A, the shape of a horizontal cross section (i.e., the cross section perpendicular to the Z direction) of each of the cut-and-raised portions 5*a*-5*c* tapers toward the upstream side. Specifically, the horizontal cross-sectional shape of the cut-and-raised portions 5*a*-5*c* is formed in a semicircular shape in the present embodiment. The diameter of a semicircle formed by the horizontal cross section of each of cut-and-raised portions 5*a*-5*c* is, for example, from 0.2 mm to 1.0 mm.

In another aspect, the shape of the cut-and-raised portions 5*a*-5*c* may be identified in the following manner. First, the aligning direction of the fins 3 (i.e., the thickness direction of the portion that is not cut and raised) is set as a height direction HL, and a cross section parallel to the height direction HL and a flow direction AL of air A (airflow direction) is defined as the horizontal cross section of the fin 3. The cut-and-raised portion 5*a* (5*b*, 5*c*) is bent in such a manner that the tip end 5*t* of the cut-and-raised part is separated away from the plane of the fin 3 and also the tip end 5*t* of the cut-and-raised part is flipped over toward the downstream side. In addition, a semicircular space SH is formed between a portion of the cut-and-raised portion 5*a* (5*b*, 5*c*) that is flipped over toward the downstream side and the rest of the portion thereof, as shown by the region shaded by dotted lines in FIG. 3C, which shows a horizontal cross section of a location of the fin 3 where a cut-and-raised portion 5*a* (5*b*, 5*c*) is formed. Further, the shape of the cut-and-raised portion 5*a* (5*b*, 5*c*) is adjusted so that a height h of this space SH gradually becomes smaller toward the upstream side of the airflow direction AL.

It should be noted that the height h of the space SH does not need to decrease monotonically toward the upstream side of the airflow direction AL, but it is sufficient that the cut-and-raised portion 5*a* includes a portion in which the height h of the space SH decreases toward the upstream side. For example, as illustrated in FIG. 3D, the shape of the cut-and-raised portion 5*a* (5*b*, 5*c*) may be adjusted so that the space SH shows the maximum height $h_{max}$ at a location advanced from the downstream edge 5*t* (the tip end 5*t* of a cut-and-raised part) toward the upstream side of the airflow direction AL by a predetermined distance.

As illustrated in FIG. 2, a plurality of cut-and-raised portions 5*a*-5*c* are provided along the flow direction of the air A, and the dimensions of each of the plurality of cut-and-raised portions 5*a*-5*c* are adjusted so that its length with respect to the aligning direction of the plurality of heat transfer tubes 2 is greater than its length with respect to the flow direction of the air A. In other words, the direction parallel to the in-plane direction of the fin 3 and the aligning direction of the plurality of heat transfer tubes 3 may be defined as the longitudinal direction of each of the plurality of cut-and-raised portions 5*a*-5*c*. In this case, the longitudinal direction (Z direction) length UL2 of the second cut-and-raised portion 5*b* is equal to the longitudinal direction length of the third cut-and-raised portion 5*c*. On the other hand, the longitudinal direction length UL1 of the first cut-and-raised portion 5*a* is longer than the longitudinal direction length UL2 of the second cut-and-raised portion 5*b*. Herein, the longitudinal direction length UL1 of the first cut-and-raised portion 5*a* is two times the longitudinal direction length UL2 of the second cut-and-raised portion 5*b*. It should be noted, however, that the longitudinal direction lengths of the first to third cut-and-raised portions 5*a*-5*c* may be equal to each other, or all of them may be different from each other.

The longitudinal direction length UL1 of the first cut-and-raised portion 5*a* is greater than the gap PG of the heat transfer tubes 2 that are adjacent to each other, but less than the center-to-center distance PP of the heat transfer tubes 2 that are adjacent to each other. On the other hand, the longitudinal direction length UL2 of the second cut-and-raised portion 5*b* and the third cut-and-raised portion 5c is greater than ½ of the just-mentioned gap PG but less than the just-mentioned gap PG.

As illustrated in FIG. 3A, the first to third cut-and-raised portions 5*a*-5*c* are formed so that the directions of the cutting and raising alternate with one another. Specifically, referring to FIG. 3A, the first cut-and-raised portion 5*a* is cut and raised upward, the second cut-and-raised portion 5*b* is cut and raised downward, and the third cut-and-raised portion 5*c* is cut and raised upward. In other words, in the present embodiment, the cut-and-raised portions that are adjacent to each other along the airflow direction are cut and raised in alternately opposite directions from the fin 3 (more specifically, from the portion of the fin 3 that is not cut and raised).

As illustrated in FIG. 3A, the lengths UH (total lengths) of the first to third cut-and-raised portions 5*a*-5*c* with respect to the airflow direction are equal to each other. It should be noted, however, that the total lengths UH of the first to third cut-and-raised portions 5*a*-5*c* may not necessarily be the same, but they may be different from each other. For example, the total length UH of the first to third cut-and-raised portions 5*a*-5*c* may either gradually decrease or gradually increase.

The raised heights UW of the first to third cut-and-raised portions 5*a*-5*c* are also equal to each other. It should be noted that, herein, the raised height UW refers to the distance from the center of the plate thickness of the fin 3. It is preferable that the raised height UW be equal to or less than ½ of the fin pitch FP. The reason is that, if the raised height UW is equal to or less than ½ of the fin pitch FP, the cut-and-raised portions 5*a*-5*c* of the adjacent fins 3 do not overlap when the heat exchanger 1 is viewed from the upstream side toward the downstream side of the airflow (when viewed in the X direction), preventing pressure loss from increasing.

Figure 3B:
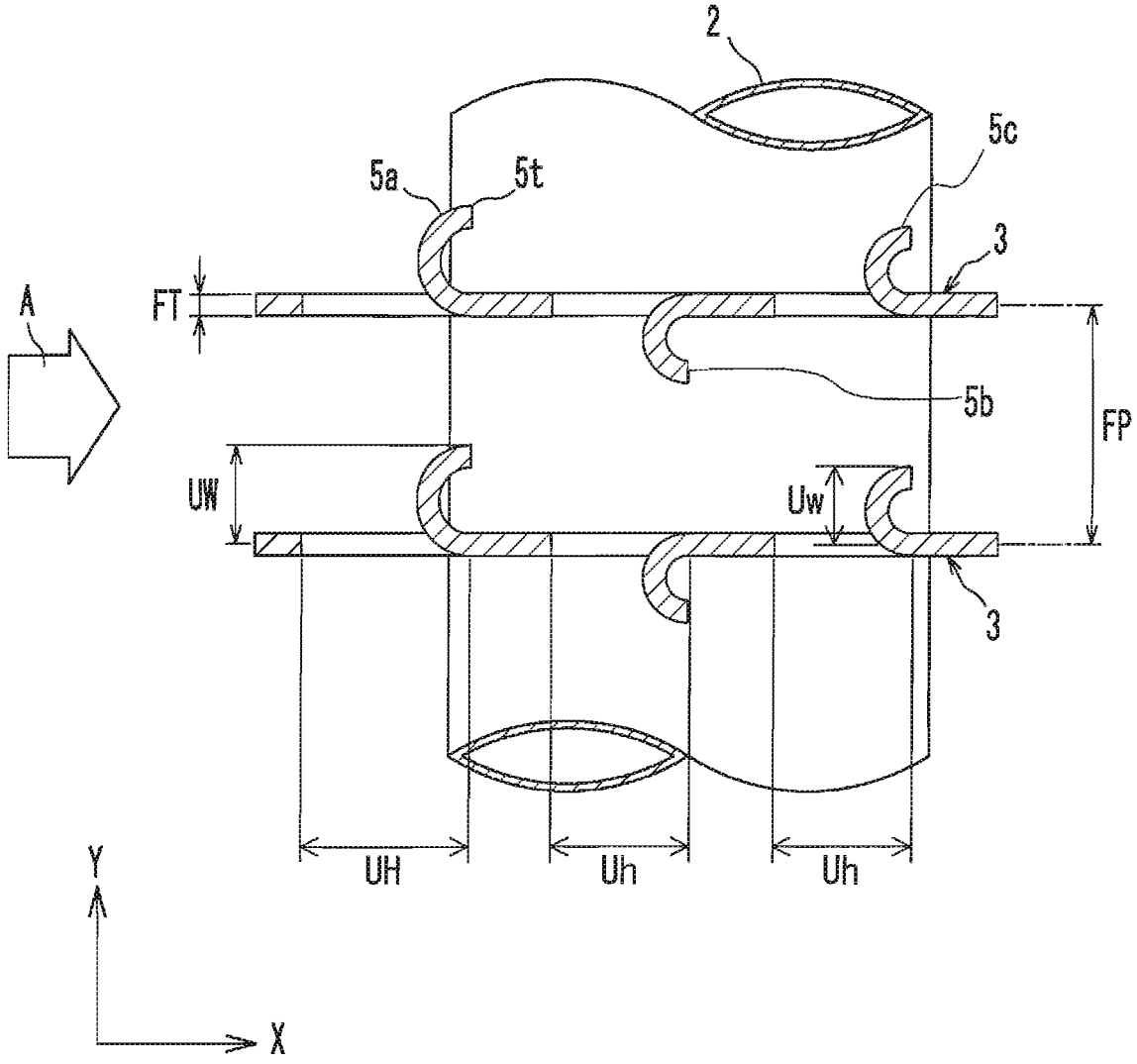
FIG. 3B is an enlarged view (cross-sectional view taken along line III-III) of the primary portion of the fin-tube heat exchanger according to a modified example of Embodiment 1.
Figure 3C:
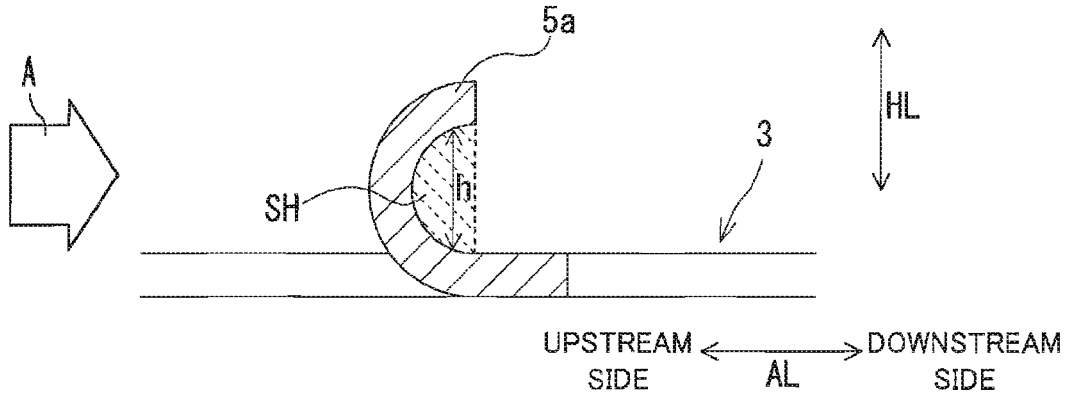
FIG. 3C is an illustrative view of the horizontal cross-sectional shape of a cut-and-raised portion.
Figure 3D:
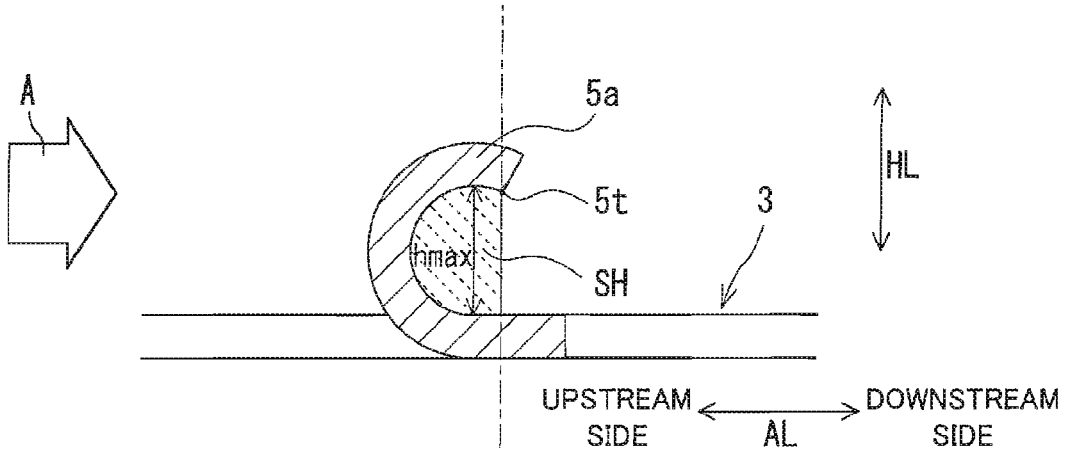
FIG. 3D is horizontal cross-sectional view of a modified example of the cut-and-raised portion.

In a modified example shown in FIG. 3B, the length UH of the first cut-and-raised portion 5*a*, which is the cut-and-raised portion located on the most upstream side with respect to the airflow direction, is longer than the length Uh of the second and third cut-and-raised portions 5*b* and 5*c*, which are the other cut-and-raised portions, with respect to the airflow direction. In addition, the raised height UW of the first cut-and-raised portion 5*a* is higher than the raised height Uw of the second and third cut-and-raised portions 5*b* and 5*c*.

It should be noted that in the present specification, the length UH of the cut-and-raised portions 5*a*-5*c* with respect to the flow direction of the air A is referred to as airflow direction length UH of the cut-and-raised portions 5*a*-5*c*. An airflow direction length UH of the cut-and-raised portions 5*a*-5*c* agrees with the length from the upstream edge to the downstream edge of an opening created by forming the cut-and-raised portion 5*a*-5*c*, as illustrated in FIG. 3A and so forth.

Next, the principle of heat transfer enhancement in the present heat exchanger 1 will be discussed.

Figure 4:
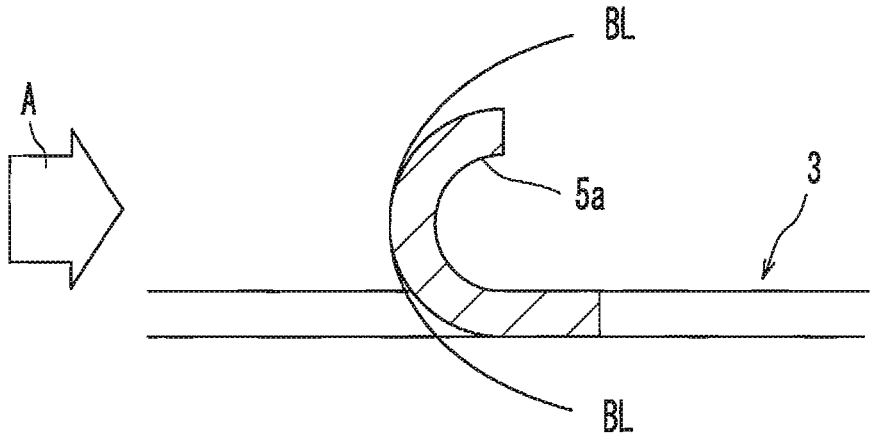
FIG. 4 is a horizontal cross-sectional view of a cut-and-raised portion.

In the heat exchanger 1, when air A (see FIG. 3A) is supplied from the front, thermal boundary layers are formed from the front edges of the fins 3 toward the rear. At the same time, thermal boundary layers are also formed at the first to third cut-and-raised portions 5*a*-5*c*. FIG. 4 shows a thermal boundary layer BL at a first cut-and-raised portion 5*a*. Since the first cut-and-raised portion 5*a* has a horizontal cross-sectional shape tapering toward the upstream side, as illustrated in FIG. 4, the air flows along the surface of the first cut-and-raised portion 5*a* thinly, and the thickness of the thermal boundary layer BL becomes thin. Specifically, the thermal boundary layer BL becomes wider toward the rear, and the first cut-and-raised portion 5*a* also is formed in a shape such as to become wider toward the rear. Accordingly, the thermal boundary layer BL is kept thin not only at the front edge but also at the rear of the first cut-and-raised portion 5*a*. As a result, the heat transfer coefficient of the first cut-and-raised portion 5*a* improves remarkably.

Although not shown in the drawings, almost the same thermal boundary layers are formed also at the second cut-and-raised portion 5*b* and the third cut-and-raised portion 5*c*. As a result, the heat transfer coefficient remarkably improves also at the second cut-and-raised portion 5*b* and the third cut-and-raised portion 5*c* for the same reason as described above.

As illustrated in FIG. 2, the shape (outer shape) of the plurality of cut-and-raised portions 5*a*-5*c* is a quadrangular shape having a longitudinal direction (for example, in a rectangular shape, or a trapezoidal shape in which the longer sides and the shorter sides are perpendicular to the airflow direction) when the fin 3 is viewed in plan in the thickness direction, and the orientations of the plurality of cut-and-raised portions 5*a*-5*c* are uniform so that the longitudinal direction is perpendicular to the airflow direction. When the shape and the positional relationship of cut-and-raised portions 5*a*-5*c* are configured in this way, the following advantageous effects are obtained.

Figure 5A:
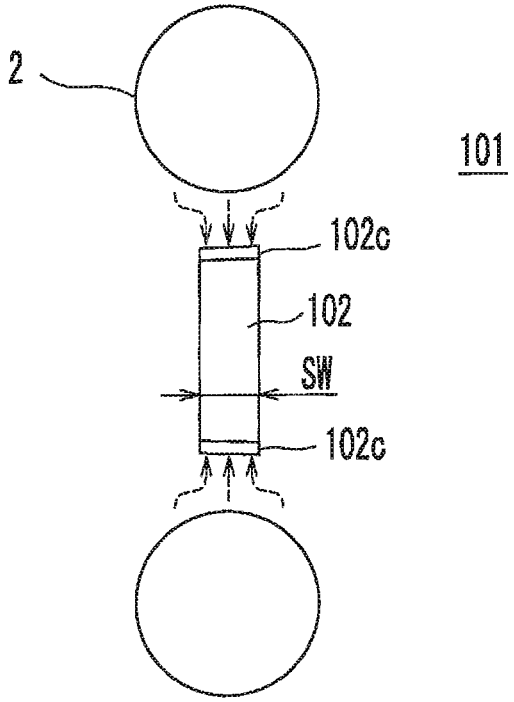
FIG. 5A is a conceptual view illustrating heat transfer in a slit fin.
Figure 5B:
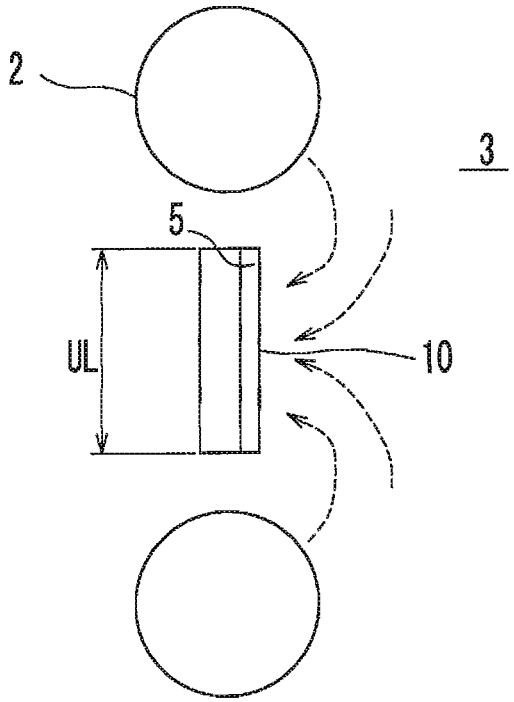
FIG. 5B is a conceptual view illustrating heat transfer in a fin according to an embodiment.

In the conventional slit fin 101, heat is supplied to a slit portion 102 through a basal portion 102*c* of the slit portion 102, as illustrated in FIG. 5A. However, since the basal portion 102*c* extends in a direction perpendicular to the longitudinal direction of the slit portion 102, the width SW of the basal portion 102*c* is small. Consequently, the heat supply path to the slit portion 102, serving as a heat transfer enhancing portion, was narrow in the slit fin 101. Thus, although the slit portion 102 has a high heat transfer coefficient locally, the heat supply is not necessarily sufficient. In contrast, in the present heat exchanger 1 (the fin 3), a basal portion 10 of the cut-and-raised portion 5 extends in the longitudinal direction of the cut-and-raised portion 5 (in a vertical direction in FIG. 5B), as illustrated in FIG. 5B, so the width UL of the basal portion 10 is wide. As a result, a sufficient amount of heat is supplied to the cut-and-raised portion 5. Therefore, according to the present the heat exchanger 1 (the fin 3), heat exchange performance can be improved also from the viewpoint of the amount of heat supplied to the heat transfer enhancing portion.

In this way, the present the heat exchanger 1 can improve the heat transfer coefficient of the cut-and-raised portions 5*a*-5*c* significantly over the case in which slit-shaped cut-and-raised portions are provided. As a result, the average heat transfer coefficient of the heat exchanger 1 can be increased. Moreover, a sufficient amount of heat can be supplied to the cut-and-raised portions 5*a*-5*c*. Furthermore, there is no risk of making the manufacturing process noticeably more difficult than the prior art since the heat transfer enhancing portions can be formed by merely cutting and raising portions of the fin 3. Thus, heat transfer coefficient can be improved over the prior art while maintaining easy manufacturability.

In addition, in the present embodiment, the horizontal cross-sectional shape of each of the cut-and-raised portions 5*a*-5*c* is formed in a semicircular shape, as illustrated in FIG. 3A. The width of each of the cut-and-raised portions 5*a*-5*c* in the horizontal cross section along the direction perpendicular to the airflow direction (the Y direction indicated in the figure) increases from the upstream side toward the downstream side, reaching the maximum at the downstream edge of each of the cut-and-raised portions 5*a*-5*c*. It should be noted that the phrase "the downstream edge of a cut-and-raised portion" means the tip end of the portion that has been cut and raised (cf. reference character 5*t* in FIG. 3A). In a heat transfer enhancing body having a columnar horizontal cross section, as in the conventional pin fins, the downstream side area becomes a dead fluid region, so the heat transfer coefficient of the downstream side area is low. In contrast, the horizontal cross section is semicircular in the cut-and-raised portions 5*a*-5*c* according to the present embodiment, and therefore, the dead water region can be reduced. As a result, the heat transfer coefficient can be improved effectively.

Although it is sufficient that the cut-and-raised portions 5*a*-5*c* are configured to taper toward the upstream side, the cut-and-raised portions 5*a*-5*c* are formed in a semicircular shape particularly in the present embodiment. This prevents the boundary layer from developing more effectively and improves heat transfer coefficient further.

In addition, in the present embodiment, the cut-and-raised portions that are adjacent to each other along the airflow direction are cut and raised in alternately opposite directions. For this reason, the second cut-and-raised portion 5*b* is not affected easily by the thermal boundary layer of the first cut-and-raised portion 5*a*, and the third cut-and-raised portion 5*c* not affected easily by the thermal boundary layer of the second cut-and-raised portion 5*b*. As a result, the heat transfer coefficient of the second cut-and-raised portion 5*b* and the third cut-and-raised portion 5*c* can be improved further.

Moreover, in the present embodiment, the raised height UW of the cut-and-raised portions 5*a*-5*c* is set at ½ or less of the fin pitch FP. This prevents pressure loss from increasing considerably. That said, there may be cases where an increase in pressure loss is permitted to some degree, depending on, for example, the use of the heat exchanger 1. In such a case, the raised height UW may be greater than ½ of the fin pitch FP. The lower limit of the raised height UW of the cut-and-raised portions 5*a*-5*c* may be, but is not particularly limited to, ⅕ or greater the fin pitch FP (but should exceed 2 times the thickness FT of the fin 3).

Figure 6:
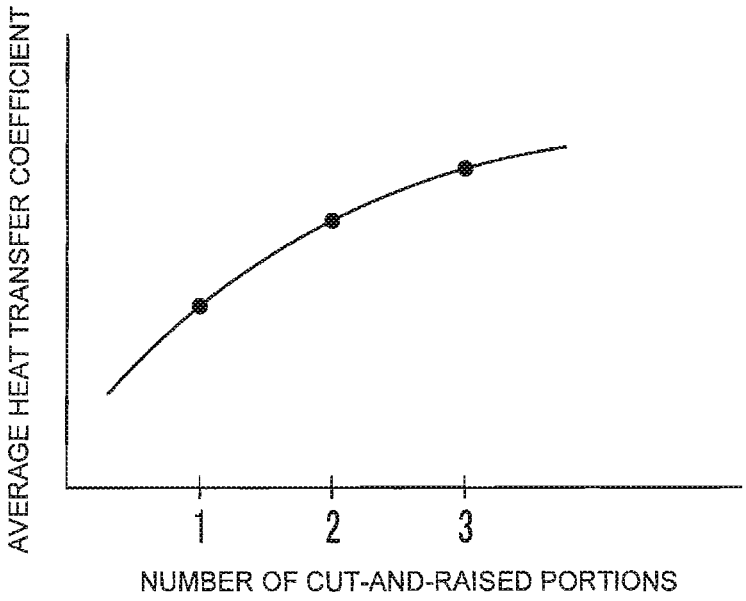
FIG. 6 is a graph illustrating the relationship between number of cut-and-raised portions and average heat transfer coefficient.

In general, as schematically illustrated in FIG. 6, the greater the number of the cut-and-raised portions is, the higher the heat transfer coefficient will be, but the rate of the increase gradually becomes small. On the other hand, the greater the number of the cut-and-raised portions, the more complicated the manufacturing process will be and the greater the pressure loss will be. In the present embodiment, however, the number of the cut-and-raised portions 5*a*-5*c* is 3 (a plural number) along the airflow direction. As illustrated in FIG. 3A, the total of the lengths UH of the plurality of the cut-and-raised portions 5*a*-5*c* with respect to the airflow direction is set to be ½ to ⅔ of the airflow direction length L of the fin 3 (=the length of the shorter side of the fin 3). That is, $\frac{1}{2} \leq 3 \cdot UH/L \leq \frac{2}{3}$. As a result, the heat transfer coefficient can be improved without complicating the manufacturing process or considerably increasing pressure loss.

The proportion of the airflow direction length UH of the cut-and-raised portions 5*a*-5*c* relative to the airflow direction length L of the fins 3 may be varied depending on the number of rows of the heat transfer tubes 2. The proportion described above is that for the case where the number of the heat transfer tubes 2 penetrating the fins 3 is 1. Likewise, the number of the cut-and-raised portions 5*a*-5*c* is also that for the case where the number of the heat transfer tubes 2 penetrating the fins 3 is 1.

The first cut-and-raised portion 5*a*, which is located on the most upstream side, has a relatively large heat transfer coefficient. In the present embodiment, the longitudinal direction length of the first cut-and-raised portion 5*a* is made longer than the longitudinal direction length of the other cut-and-raised portions 5*b* and 5*c*. Thus, the area of the portion with a large heat transfer coefficient is large. Therefore, the heat transfer coefficient can be improved effectively.

In addition, in the present the heat exchanger 1, the velocity boundary layers of the cut-and-raised portions 5*a*-5*c* become thin. Therefore, even when dew condensation occurs on the surfaces of the fins 3, the water film tends to be thin. For this reason, even when dew condensation occurs, the heat transfer enhancement effect does not lower easily, and pressure loss does not increase easily either.

(Embodiment 2)

Figure 7:
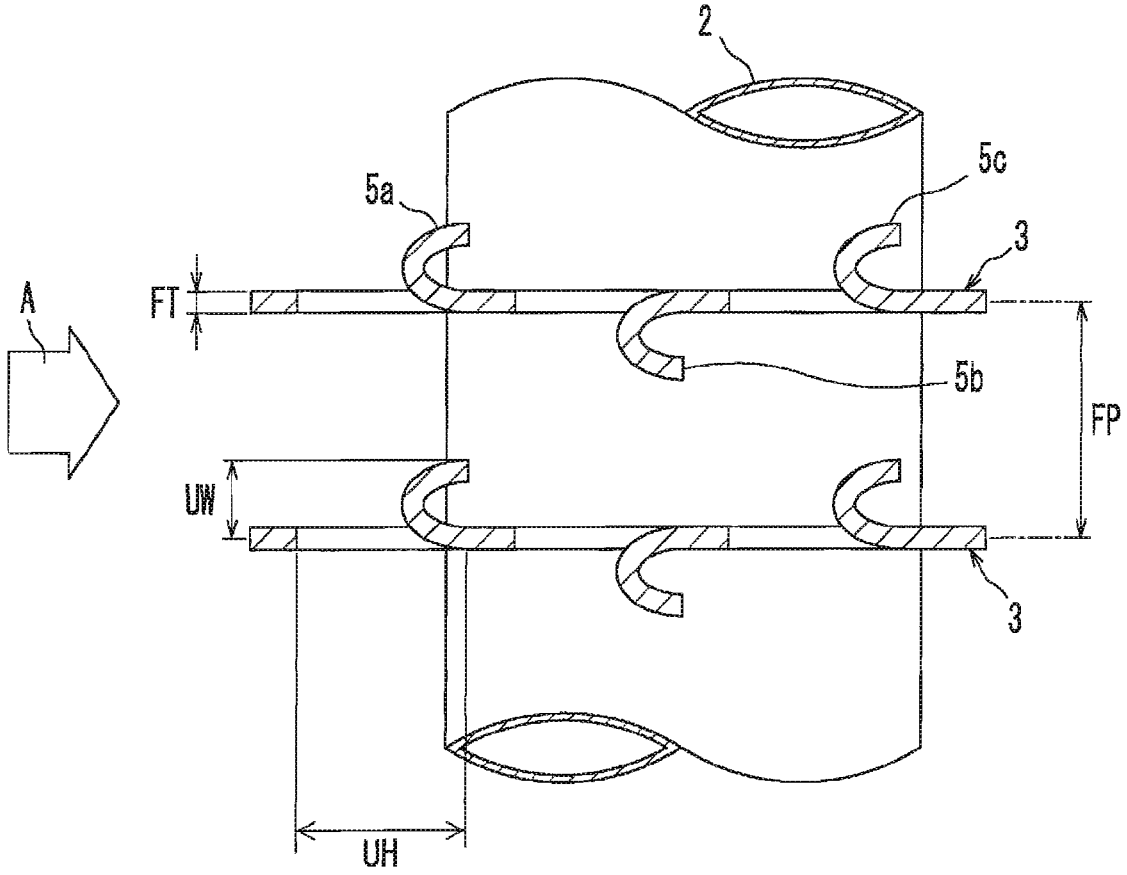
FIG. 7 is an enlarged view of a primary portion of the fin-tube heat exchanger according to Embodiment 2.

In Embodiment 1, the cut-and-raised portions 5*a*-5*c* are formed to have a horizontal cross-sectional shape in a semicircular shape. However, the horizontal cross-sectional shape of the cut-and-raised portions 5*a*-5*c* is not limited to the semicircular shape. As illustrated in FIG. 7, a fin-tube the heat exchanger 1 according to Embodiment 2 is such that the horizontal cross-sectional shape of the cut-and-raised portions 5*a*-5*c* is formed in a semielliptic shape.

Specifically, each of the fins 3 of the heat exchanger 1 according to Embodiment 2 has cut-and-raised portions 5a-5c formed by cutting and raising portions of the fin 3 so as to be turned over from the upstream side toward the downstream side. The cut-and-raised portions 5a-5c are curved so that the horizontal cross-sectional shape tapers toward the upstream side, and are formed in a semielliptic shape. The rest of the configurations are the same as those in Embodiment 1 and the description thereof will be omitted.

Figures 8A, 8B:
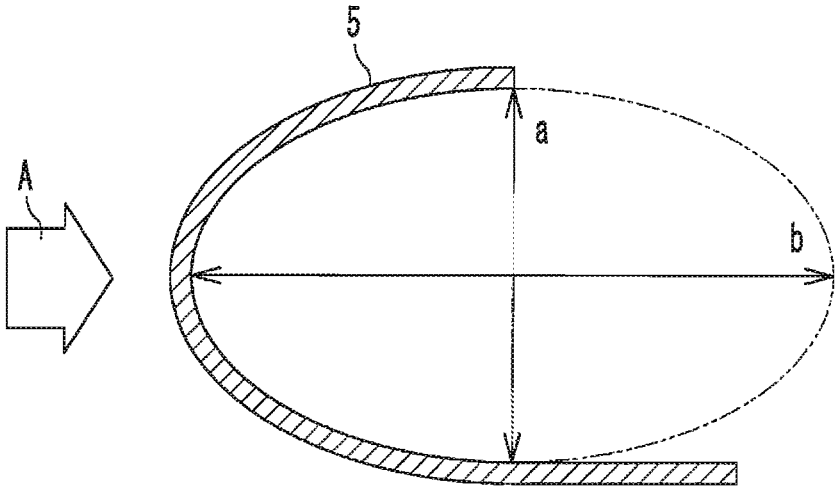
FIG. 8A is a schematic view for illustrating ellipticity.
FIG. 8B is a table illustrating the relationship between ellipticity and average heat transfer coefficient and pressure loss.

In the present embodiment, the cut-and-raised portions 5a-5c have the same equal ellipticity, as defined in FIG. 8A (the ratio of the shorter axis a to the longer axis b=a/b). However, the cut-and-raised portions 5a-5c may have different ellipticities from each other. FIG. 8B shows the simulation results of average surface heat transfer coefficient and pressure loss relative to ellipticity. In the table of FIG. 8B, average surface heat transfer coefficient and pressure loss are represented taking the average surface heat transfer coefficient and the pressure loss in the case where ellipticity=1 (semicircular shape) as references (=1). As will be appreciated from this table, when the ellipticity is greater than 0.33 but less than 1, the heat transfer coefficient can be kept at substantially the same level while reducing the pressure loss relative to one in which the horizontal cross section of the cut-and-raised portions 5a-5c is in a semicircular shape (Embodiment 1). It should be noted that the simulation was carried out under the condition $3 \cdot UH/L \approx 0.6$.

In the present embodiment as well, the horizontal cross-sectional shape of the cut-and-raised portions 5a-5c is formed to taper toward the upstream side. As a result, the thermal boundary layers at the cut-and-raised portions 5a-5c can be made thin, as in Embodiment 1. Therefore, the heat transfer coefficient can be improved. Moreover, the horizontal cross-sectional shape of the cut-and-raised portions 5a-5c is formed in a semielliptic shape, in the present embodiment. As a result, pressure loss can be reduced further than Embodiment 1.

In particular, the cut-and-raised portions 5a-5c are formed so that the longer axis direction of the horizontal cross section thereof is parallel to the airflow direction. As a result, it becomes possible to reduce pressure loss further.

Moreover, if the ellipticity of the cut-and-raised portions 5a-5c is set to be greater than 0.33 but less than 1, pressure loss can be reduced while keeping the heat transfer coefficient at the same or a higher level than the one in which the horizontal cross section of the cut-and-raised portions 5a-5c is in a semicircular shape.

(Embodiment 3)

Figure 9:
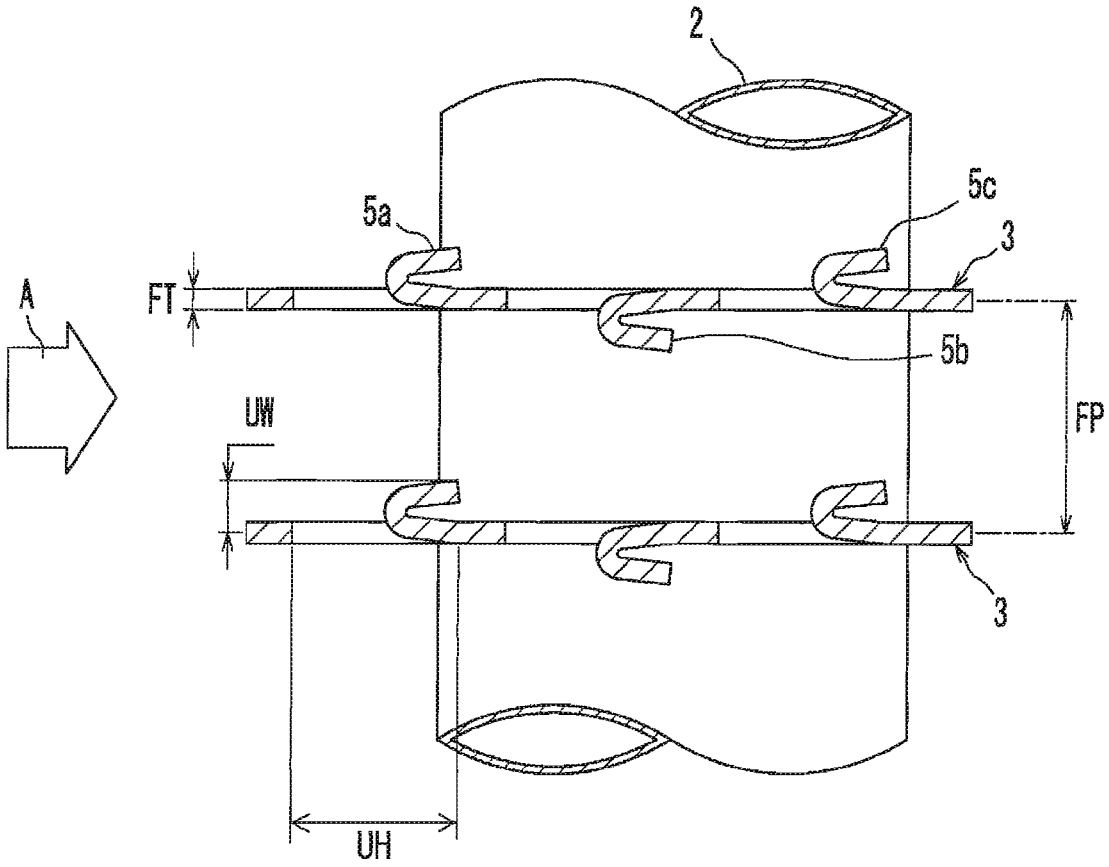
FIG. 9 is a horizontal cross-sectional view illustrating a cut-and-raised portion of a fin-tube heat exchanger according to Embodiment 3.

As illustrated in FIG. 9, a fin-tube the heat exchanger 1 according to Embodiment 3 is such that the horizontal cross-sectional shape of the cut-and-raised portions 5a-5c is formed in a wedge shape.

Specifically, each of the fins 3 of the heat exchanger 1 according to Embodiment 3 has cut-and-raised portions 5a-5c formed by cutting and raising portions of the fin 3 so as to be turned over from the upstream side toward the downstream side. The cut-and-raised portions 5a-5c are curved so that the horizontal cross-sectional shape tapers toward the upstream side, and are formed in a wedge shape. It should be noted that the term "wedge shape" refers to a shape such as to continuously spread from the front edge to the rear edge. The rest of the configurations are the same as those in Embodiment 1 and the description thereof will be omitted.

In the present embodiment as well, the horizontal cross-sectional shape of the cut-and-raised portions 5a-5c is formed to taper toward the upstream side. Therefore, the thermal boundary layers at the cut-and-raised portions 5a-5c can be made thin, as in the case of Embodiment 1. As a result, the heat transfer coefficient can be improved. In the present embodiment, the cut-and-raised portions 5a-5c continuously spread from the front edge to the rear edge, so the thermal boundary layers can be made thin even at the rear edges of the cut-and-raised portions 5a-5c. As a result, the heat transfer coefficient can be improved further.

Figure 10:
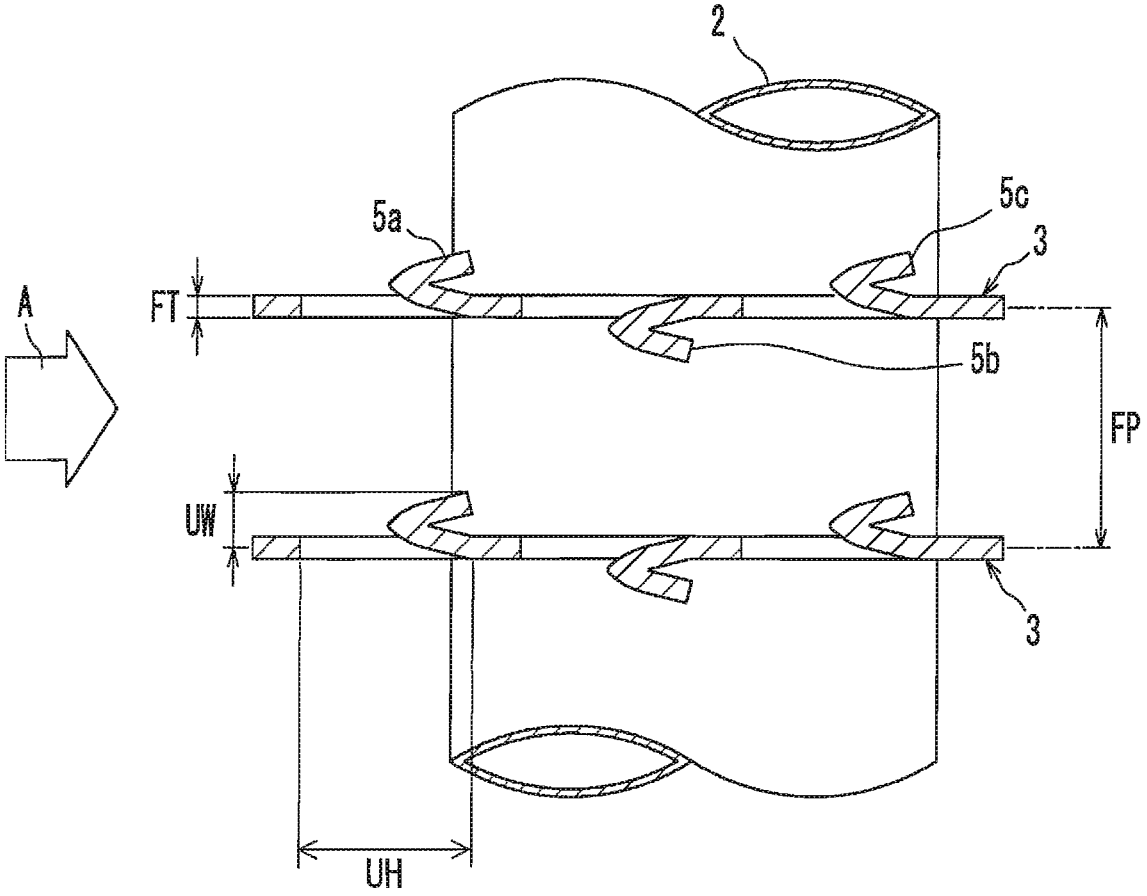
FIG. 10 is a horizontal cross-sectional view illustrating a cut-and-raised portion according to a modified example.

In the present embodiment, front edges of the cut-and-raised portions 5a-5c are described to be round, but the front edges of the cut-and-raised portions 5a-5c do not need to be round. The front edges of the cut-and-raised portions 5a-5c may have sharp points, as illustrated in FIG. 10. The horizontal cross-sectional shape of each of the cut-and-raised portions 5a-5c may be formed in an bent shape.

(Other Embodiments)

In each of the foregoing embodiments, the horizontal cross section of the front edge portion of each of the fins 3 is formed in a half-rectangular shape. However, the horizontal cross-sectional shape of the front edge portion of the fin 3 may be semicircular, semielliptic, or in a wedge shape, similar to the cut-and-raised portions 5a-5c.

Figure 11A:
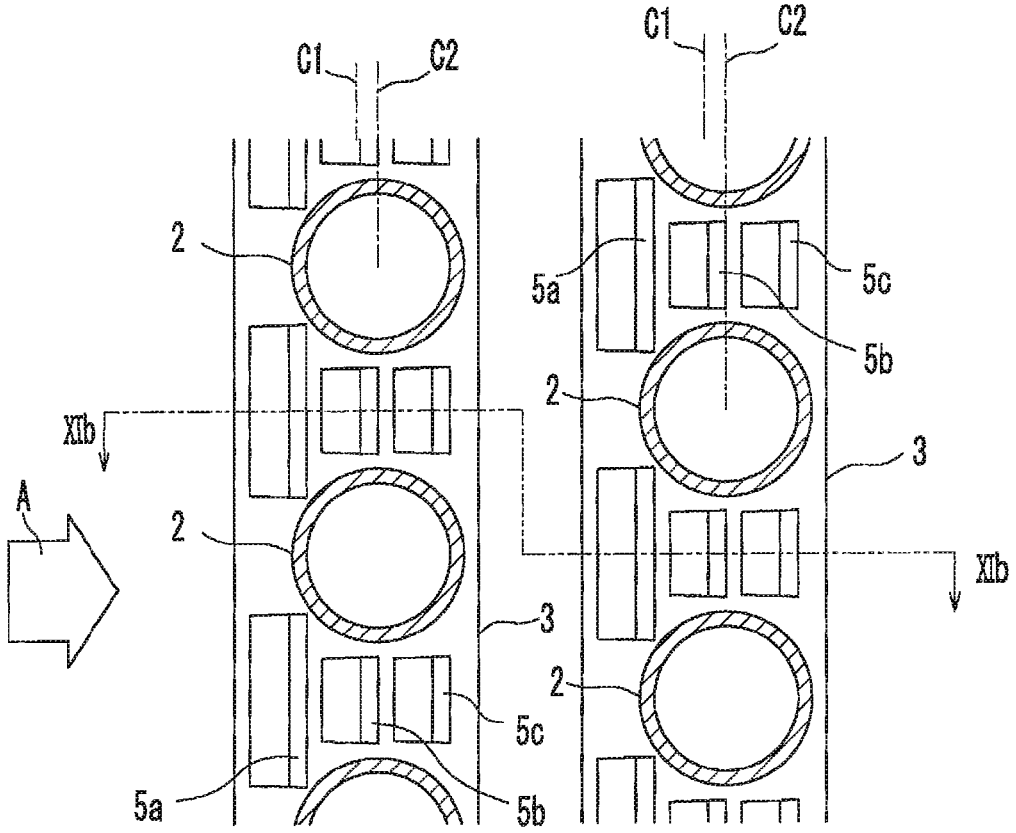
FIG. 11A is a partial elevational view of a fin-tube heat exchanger according to another embodiment.
Figure 11B:
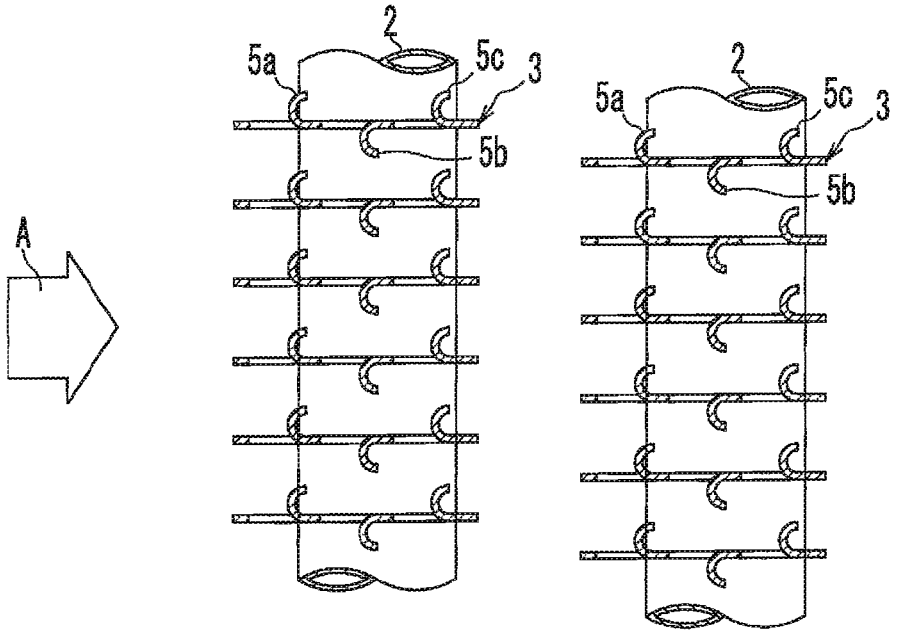
FIG. 11B is a cross-sectional view taken along line XIb-XIb in FIG. 11A.
Figure 12A:
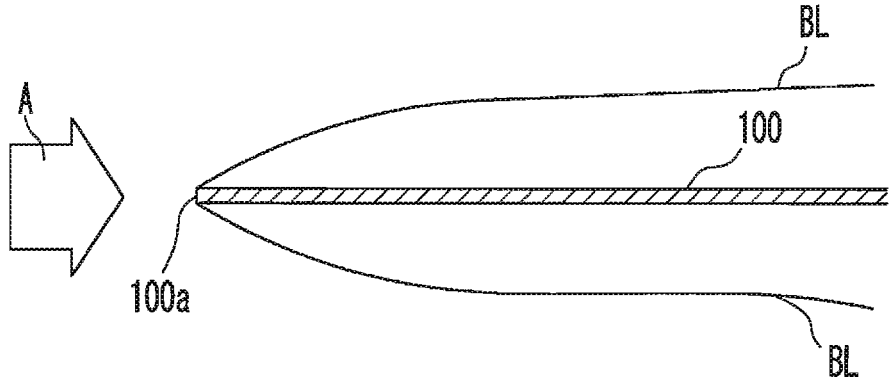
FIG. 12A is a horizontal cross-sectional view of a flat fin.
Figure 12B:
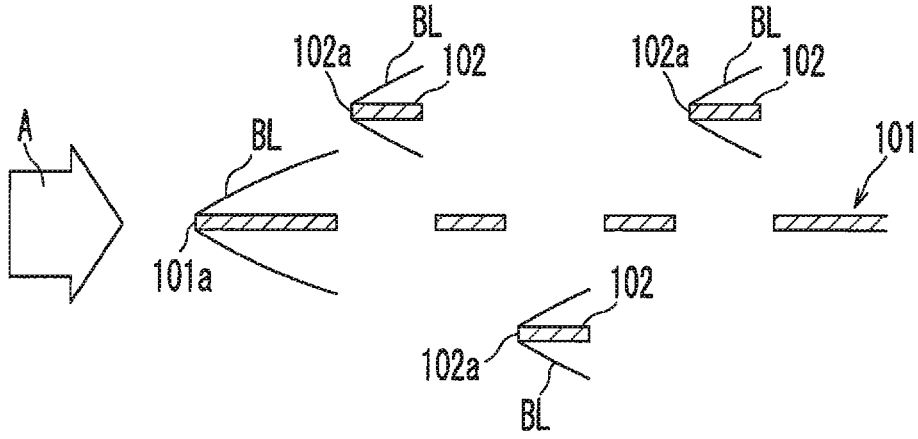
FIG. 12B is a horizontal cross-sectional view of a slit fin.

In the fin-tube the heat exchanger 1 of each of the foregoing embodiments, the number of rows of the heat transfer tubes 2 is 1. However, the number of rows of the heat transfer tubes 2 may be 2 or more. When the number of rows of the heat transfer tubes 2 is 2 or more, the fins 3 may be either integral ones that are common to the respective rows, or separate fins provided respectively for the respective rows. For example, when the number of rows of the heat transfer tubes 2 is 2, the fins for the first row and the fins for the second row may be isolated from each other. As illustrated in FIGS. 11A-B, it is also possible to dispose the fins for the first row and the fins for the second row in a staggered manner and to locate the fins 3 for the second row between the fins 3 for the first row.

INDUSTRIAL APPLICABILITY

As has been described above, the present invention is useful for fin-tube heat exchangers.

The invention claimed is:

1. A fin-tube heat exchanger comprising:

a plurality of fins spaced apart from and parallel to each other; and a plurality of heat transfer tubes penetrating said fins, said fin-tube heat exchanger configured to exchange heat between a first fluid flowing on a surface side of said fins and a second fluid flowing inside said heat transfer tubes, wherein a cut-and-raised portion is formed in each of said fins, said cut-and-raised portion being formed by cutting and raising a portion of said each of said fins so as to be turned over from an upstream side where the first fluid enters, to a downstream side where the first fluid exits, said cut-and-raised portion having a horizontal cross-sectional shape that is curved or bent so as to taper toward the upstream side, the horizontal cross-sectional shape of said cut-and-raised portion being viewed in a direction that is perpendicular to a flow direction of the first fluid from the upstream side to the downstream side and is parallel to said fins, an opening is formed of the cut-and-raised portion, the opening being located on the upstream side of said cut-and-raised portion, said cut-and-raised portion provided for one of said fins is spaced apart from another of said fins adjacent to one of said fins, a plurality of said cut-and-raised portions are provided along the flow direction of the first fluid, a length of each of said cut-and-raised portions along a direction parallel to an aligning direction of said plurality of heat transfer tubes is greater than a length of each of said cut-and-raised portions along a direction parallel to the flow direction of the first fluid, when the direction parallel to the aligning direction of said plurality of heat transfer tubes is defined as a longitudinal direction of each of said plurality of cut-and-raised portions, orientations of said plurality of cut-and-raised portions are uniform so that the longitudinal direction is perpendicular to the flow direction of the first fluid, each said cut-and-raised portion includes a front edge located on the upstream side and a rear edge located on the downstream side, the front edge and the rear edge extend in a direction parallel to the longitudinal direction, when the first fluid flowing from the upstream side to the downstream side collides with said front edge of each of said plurality of cut-and-raised portions, a part of the first fluid flows on one face side of each said fin toward the rear edge of each of said plurality of cut-and-raised portions, and another part of the first fluid flows on another face side of each said fin through the opening, the shape of said plurality of cut-and-raised portions is a quadrangular shape when said fins are viewed in a plane in a thickness direction, each of said cut-and-raised portions further includes two curved side surfaces each parallel to the flow direction of the first fluid and a basal portion parallel to the longitudinal direction, a length of the basal portion in the longitudinal direction is greater than an entire length of either of the curved side surfaces, each of said cut-and-raised portions is cut and raised upward or downward of said fin, each of said cut-and-raised portions that are cut and raised upward of said fin are entirely located above a lower surface of said fin, each of said cut-and-raised portions that are cut and raised downward of said fin are entirely located below an upper surface of said fin, and a length of the opening formed of the cut-and-raised portion that is in the direction parallel to the flow direction of the first fluid and is located at a most upstream side along the direction parallel to the flow direction of the first fluid, is longer than a corresponding length of any other opening formed of the cut-and-raised portion that is located at the downstream side relative to the cut-and-raised portion at the most upstream side, along the direction parallel to the flow direction of the first fluid.

2. The fin-tube heat exchanger according to claim 1, wherein the horizontal cross sectional shape of said cut-and-raised portion is a semicircular shape.

3. The fin-tube heat exchanger according to claim 1, wherein the horizontal cross sectional shape of said cut-and-raised portion is a semielliptic shape.

4. The fin-tube heat exchanger according to claim 1, wherein the horizontal cross sectional shape of said cut-and-raised portion is a semielliptic shape that is slender toward the upstream side.

5. The fin-tube heat exchanger according to claim 1, wherein the horizontal cross sectional shape of said cut-and-raised portion is a wedge shape.

6. The fin-tube heat exchanger according to claim 1, wherein said cut-and-raised portions that are adjacent to each other along the flow direction of the first fluid are cut and raised in alternately opposite directions from each of said fins.

7. The fin-tube heat exchanger according to claim 1, wherein a raised height of said cut-and-raised portion is equal to or less than ½ of a fin pitch.

8. The fin-tube heat exchanger according to claim 1, wherein a total length of said cut-and-raised portions along a direction parallel to the flow direction of the first fluid is in a range from ½ to ⅔ of a length of said fins along a direction parallel to the flow direction of the first fluid.

9. The fin-tube heat exchanger according to claim 1, wherein a number of said cut-and-raised portions along the flow direction of the first fluid is equal to or less than 3 per one row of said heat transfer tubes.

10. The fin-tube heat exchanger according to claim 1, wherein the cut-and-raised portion is spread continuously from the front edge thereof to the rear edge thereof.

11. The fin-tube heat exchanger according to claim 1, wherein:

said fins are provided in a plurality of rows in the flow direction of the first fluid; and said fins for a first row of the plurality of rows and said fins for a second row of the plurality of rows are isolated from each other, and said fins are disposed in a staggered orientation such that said fins for the second row are disposed between said fins for the first row.

* * * * *